US005232502A

United States Patent [19]

Recker

[11] Patent Number: 5,232,502

[45] Date of Patent: Aug. 3, 1993

[54] PIPE HANDLING APPARATUS

[75] Inventor: Roger L. Recker, Chillicothe, Ill.

[73] Assignee: Caterpillar Inc., Peoria, Ill.

[21] Appl. No.: 820,101

[22] Filed: Jan. 13, 1992

[51] Int. Cl.[5] ..... B05B 13/06

[52] U.S. Cl. ..... 118/317; 118/DIG. 10

[58] Field of Search ..... 414/23, 745.4, 745.5; 118/317, 323, DIG. 10, 500

[56] References Cited

U.S. PATENT DOCUMENTS

| | | | |
|---|---|---|---|
| 4,682,182 | 7/1987 | Oyama et al. | 118/317 |
| 4,690,327 | 9/1987 | Takai et al. | 118/317 |
| 4,785,760 | 11/1988 | Tholome | 118/323 |
| 4,821,673 | 4/1989 | Kirigakubo et al. | 118/324 |

*Primary Examiner*—W. Gary Jones
*Assistant Examiner*—Charles K. Friedman
*Attorney, Agent, or Firm*—William C. Perry

[57] ABSTRACT

During the installation of underground utilities it is common to utilize an earthmoving machine, such as a hydraulic excavator, to dig a trench and aid in the placement of the individual pipe segments that comprise a conduit or pipeline. Normal placement of the pipe segments require communication between the excavator operator and a laborer that is positioned adjacent the pipe in the trench. As the pipe segments are lowered into position, the laborer insures a proper connection, support, and sealing of each joint in the pipeline. The requirement of another individual in the trench is both inefficient and represents a significant increase in the cost of laying the pipeline. The present invention utilizes a pipe handling apparatus that may be inserted within a segment of pipe with an end face thereof bearing against a flange defined by a pipe supporting cylinder. This connection allows the operator to apply a force to the pipe segment in the direction of engagement with the pipeline to insure connection. A spraying apparatus is defined by the pipe handling apparatus in the pipe at a location that is generally coincident with the pipe joint Upon activation, the spraying apparatus will provide a coating of sealant entirely around the internal portion of the pipe joint. This apparatus permits the excavator operator to dig a trench and set and seal the segments of a pipeline without the aid of additional personnel.

9 Claims, 2 Drawing Sheets

PIPE HANDLING APPARATUS

DESCRIPTION

1. Technical Field

This invention relates generally to an apparatus which may be utilized to pick up and move segments of pipe and more particularly to an apparatus that may be utilized to join and seal individual pipe segments to a pipeline without the need for personnel other than the machine operator to direct the operation.

2. Background Art

In the installation of underground utilities, it has frequently been desirable to utilize a hydraulic excavator to dig a trench for placement of an underground conduit or pipeline. Similarly, the same machine is utilized to lift and maneuver each segment of pipe into the trench for end to end attachment with other segments of pipe. Typically, the pipe segments would be lifted by heavy cables or straps that engage a hook positioned on the back of the excavating bucket. The pipe segments are maneuvered from a point on the ground adjacent the trench to a point within the trench. Once in the trench, connection of the pipe segment to the existing pipeline would rely heavily upon a laborer that is also located within the trench. The laborer is able to maneuver the pipe to align it with the existing pipeline and communicate instructions to the operator of the excavator to achieve proper elevational positioning. The laborer often needs to provide movement of the pipe segment in an axial direction with respect to the existing pipeline to achieve a proper connection since the excavator merely suspended the pipe segment from the bucket. After a secure connection is achieved, the laborer then seals the connection with some type of fluid sealant to prevent leakage of the pipeline. At the same time, the laborer will normally inspect the underside of the newly placed pipe segment to insure that it is supported along its length by the bedding material laid within the trench. While this has been an effective way to set pipe within a trench, the necessary presence of the operator within the trench is both costly and relatively inefficient.

The present invention is directed to overcoming one or more of the problems as set forth above.

DISCLOSURE OF THE INVENTION

In one aspect of the present invention, a pipe handling apparatus is utilized that includes a first support beam that has a first and second end portion. An engaging arm is provided that has a first and second end portion and is sufficient for being positioned within a length of pipe. The engaging arm is connected to the first support beam by a second support beam that extends between the respective first end portions of the first support beam and the engaging arm to mount them to one another in spaced parallel relation. A means is provided to support the pipe on the engaging arm and is positioned about the engaging arm at spaced locations on the first and second end portions thereof. A means for providing a spray of fluid is included and is secured to the second end portion of the engaging arm.

With a pipe handling apparatus as set forth above, a length of pipe may easily be engaged for selective placement by inserting the engaging arm into the inner portion of the pipe member. The pipe member may then be moved about and maneuvered into engagement with a plurality of pipe segments that have been joined to form pipeline in a nearby trench. Once the pipe length has been attached to the pipeline, the spaying means may be utilized to provide an internal coating of sealant at the juncture between the length of pipe and the pipeline. By operating in such a fashion, the connecting and sealing functions that have normally been performed with the aid of a nearby laborer, may now be accomplished automatically thus eliminating the need for someone to be in the trench during connection of the pipe segments.

BEST MODE FOR CARRYING OUT THE INVENTION

Figure 1:
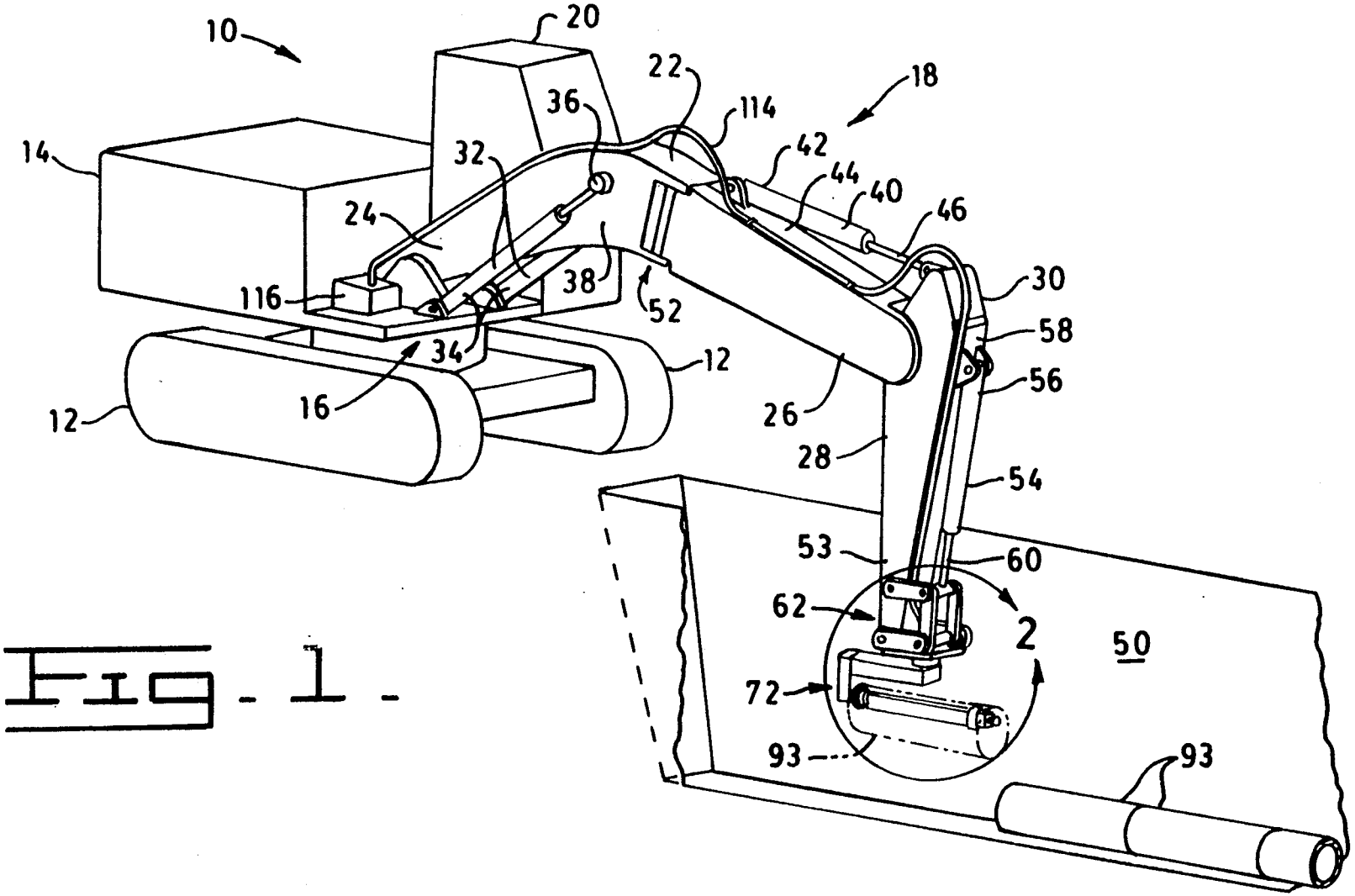
FIG. 1 is a diagrammatic perspective view of a hydraulic excavator that embodies the principles of the present invention.

Referring now to the drawings, and more particularly to FIG. 1, a hydraulic excavator 10 is shown that is supported upon a pair of spaced apart track assemblies 12. The upperstructure or house 14 is provided to enclose an engine and other related components that drive to the track assemblies. A swing gear assembly, shown generally at 16, is positioned between the house and the track assemblies and provides rotation of the house 14 with respect to the track assemblies 12 throughout 360 degrees of rotation in a generally horizontal plane. A linkage arrangement 18 is mounted to the house at a location adjacent the cab 20 of the vehicle. The linkage arrangement 18 includes a boom 22 that has a first end portion 24 mounted to the upperstructure 14 for pivotal movement with respect thereto along a substantially vertical plane. A second or distal end 26 of the boom 22 extends forwardly from the vehicle and is in turn pivotally mounted to a secondary boom or stick 28, generally in the vicinity of a first end portion 30 of the stick 28.

The boom 22 is pivoted about its mounting to the upperstructure 14 by a pair of hydraulic cylinders 32 that have a first end 34 mounted to the upperstructure and a second end 36 mounted to an intermediate portion 38 of the boom. A second hydraulic cylinder 40 has a first end 42 mounted to an upper surface 44 of the boom and a second end 46 mounted to the first end portion 30 of the stick 28. When actuated, the second cylinder 40 provides movement of the stick with respect to the boom in the same vertical plane.

To increase the maneuverability of the linkage arrangement 18 with respect to individual pipe segments that may randomly be laid along a trench 50, the boom 22 may be provided with a hinge 52 that is located in a generally central region of the boom. In this way, a limited amount of lateral shifting is permitted between the first and second end portions 24 and 26 respectively.

One of a plurality of work implements may be attached to the second end 53 of the stick 28 to perform various earth working tasks as will be discussed hereinafter. The work implement may be further manipulated with respect to the stick 28 by a third hydraulic cylinder 54 that has a first end 56 mounted to an upper surface 58 of the stick and a second end 60 that is connected to a tilt linkage arrangement 62. The tilt linkage arrangement 62 includes a pair of links 64 and 66 that extend from the stick 28 and the work implement respectively to be joined to each other and with the second end 60 of the third hydraulic cylinder 54.

In order to dig a trench 50, the excavator must employ the use of a bucket (not shown). Once the trench has been dug, the bucket may be exchanged for another implement such as a pipe handling apparatus as shown in FIG. 1 which will be described in greater detail hereinafter. In order to provide a quick exchange of implements, it is desirable to include in the mounting arrangement a quick coupling device, shown generally at 70, of any of the numerous designs that are readily available. One such coupler that has been known to work extremely well in these types of applications is disclosed in U.S. Pat. No. 4,854,813, issued to DeGeeter et al. on Aug. 8, 1989.

It is to be understood that in order to gain the maximum benefit from the subject design, it is recommended that the implement is utilized in conjunction with an excavator that employs an automatic dig function. In such a system, the operator can control the depth and the slope of a trench through the use of electronic controls incorporated into the linkage control arrangement of the excavator. A typical system that offers such capability is disclosed in U.S. Pat. 5,065,326, issued to W. C. Sahm on Nov. 12, 1991. When a system such as this is utilized, an initial requirement for an individual to be positioned within the trench is eliminated.

Figure 2:
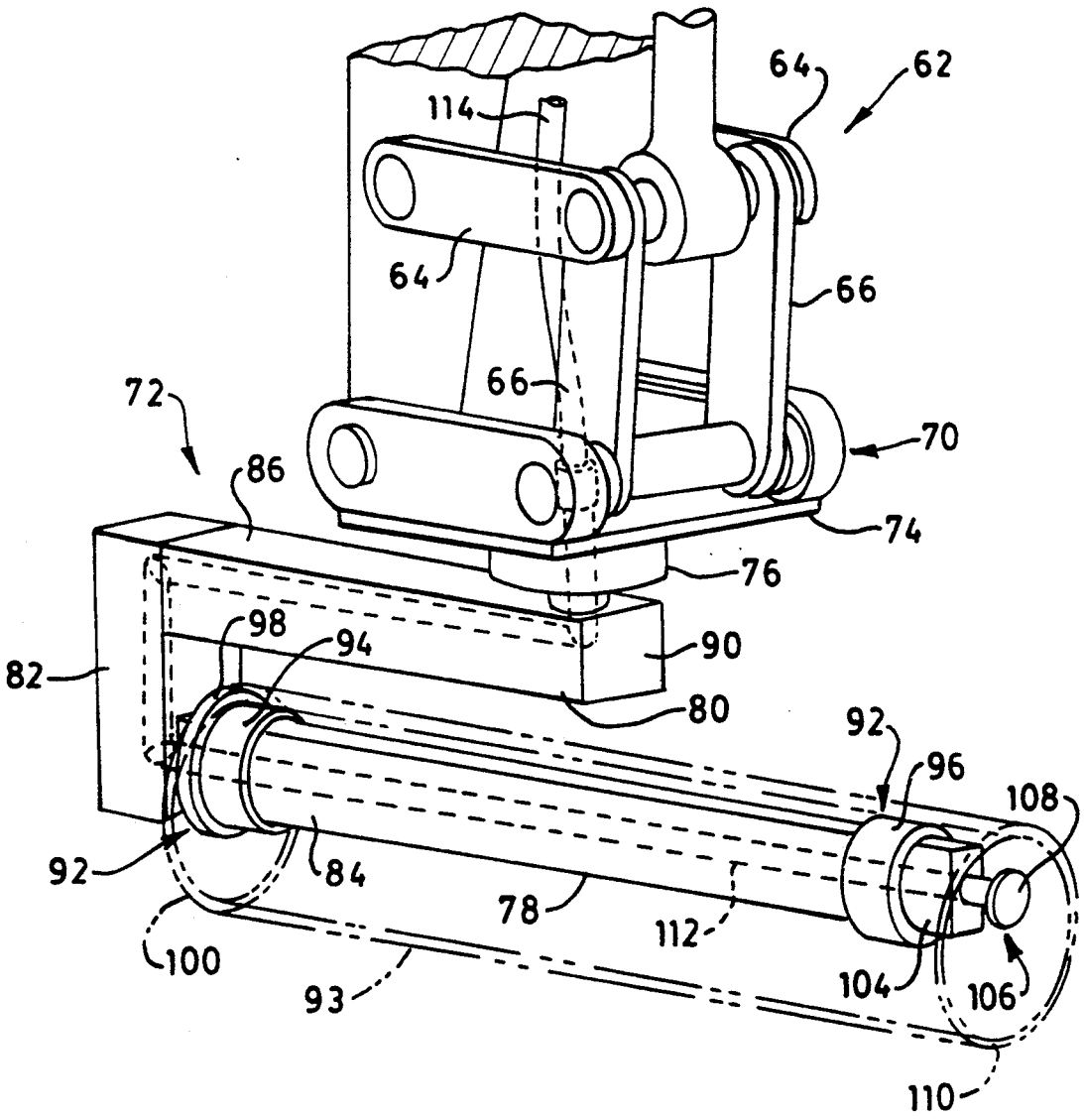
FIG. 2 is an enlarged view of the area indicated in FIG. 1.

Turning now to FIG. 2, a pipe handling apparatus 72 is disclosed in greater detail. The implement is connected to the coupling device 70 by a mounting plate 74. The mounting plate 74 in turn, mounts a rotary coupler shown generally at 76. Since any one of numerous rotary couplers are sufficient for utilization in this capacity and are well known in the art, further description of the rotary coupler is not necessary. The pipe handling apparatus 72 comprehends a main engaging arm 78 that is connected to the rotary coupler by a first and second support beam 80 and 82 respectively. The engaging arm 78 and the first support beam 80 have respective first end portions 84 and 86 that are rigidly interconnected by the second support beam 82 as by welding or the like. A second end portion 90 of the first support arm or beam 80 is connected to the rotary coupler 76 and thereby translates the rotation of the rotary coupler 76 to the engaging arm 78.

The engaging arm 78 has a means 92 for supporting a length of pipe 93 (shown in phantom lines in FIG. 2) that includes a pair of cylindrical members 94 and 96. The first cylindrical member 94 is located about the engaging arm 78 in the vicinity of the first end portion 84. A flange member 98 is positioned to extend vertically from the first cylindrical member 94 and extends upwardly a sufficient distance to engage an end face 100 of the length of pipe 93 when the pipe is properly engaged by the pipe handling apparatus 72. The second cylindrical member 96 is generally positioned about a second end portion 104 of the engaging arm 78. Both cylindrical members 94 and 96 have diameters that are sufficiently smaller than that of the pipe segment 93 to permit easy insertion of the engaging arm into the pipe segment.

A means 106 for providing a spray of fluid is connected to the engaging arm 78 and extends from the second end portion 104 thereof. The spraying means includes a nozzle 108 that extends laterally from the second end portion 104 a distance that is generally coincident with a second end portion 110 of the length of pipe 93. The nozzle is of the type that will provide a radially directed spray in a pattern that encompasses 360 degrees. A conduit 112 extends from the the nozzle 108 internally through the engaging arm 78 and both the support beams 80 and 82. The conduit 112 extends vertically along the axis of the rotary coupler 76 to be joined by a fitting with an external conduit or hose 114. The external hose extends along the stick and the boom members 28 and 22 respectively, to a reservoir of sealant 116 located on the upperstructure 14 (FIG. 1) of the excavator. It is to be understood that, while not shown in the drawings, a quick-fit type hydraulic connection could be utilized between the rotary coupler and the external conduit without departing from the intent of the invention.

INDUSTRIAL APPLICABILITY

When utilizing the present invention, the operator will employ a bucket to dig a trench 50 to a specified depth and grade and it will be back-filled with bedding material to support a continuous pipeline or conduit. After a sufficient length of the trench has been dug to accommodate a length of pipe 93, the operator will replace the bucket with the pipe handling apparatus 72 of the present invention. The operator will maneuver the linkage arrangement 18 of the excavator to engage a length of pipe 93 that is positioned on the ground adjacent the trench 68. The engaging arm 78 is inserted into the hollow of the pipe segment until the end face 100 of the pipe contacts the vertically oriented flange 98 of the first cylindrical member 94. Since the diameters of the cylindrical members 94 and 96 of the pipe supporting means 92 are necessarily smaller that the diameter of the pipe segment 93, the weight of the pipe will cause it to seek a centerline of support that is generally coincident with that of the engaging arm 78. Since the operator is placed in a position that affords him good visibility of the existing pipeline in the trench, he can maneuver the supported pipe segment 93 into position to engage the end of the pipeline. Since the vertically extending flange 98 bears against the end face 100 of the pipe segment 93, the operator, through the pipe handling apparatus 72, may apply the necessary force required to insert the second end portion 110 of the pipe segment into the existing pipeline. After making sure the last placed segment is in longitudinal alignment with the rest of the pipeline, the operator may then activate the spraying means 106. As previously described, the spray nozzle 108 is positioned generally in the vicinity of the junction between the newly connected pipe segments. Upon activation of the spraying system, the entire joint is coated with a suitable sealant to prevent leakage of the pipeline.

With a pipe handling apparatus 72 as set forth above, an operator is enabled to connect and seal the individual segments of pipe that comprise a pipeline without the necessity of another individual stationed within the trench. When coupled with the available automatic digging arrangements that are currently available, the entire operation may be accomplished in a much more efficient, cost effective manner.

Other aspects, objects and advantages of this invention can be obtained from a study of the drawings, the disclosure and the appended claims.

I claim:

1. A pipe handling apparatus, comprising:

a first support beam having a first and second end portion;

an engaging arm having a first and second end portion and being sufficient for positioning within a length of pipe;

a second support beam connected to the respective first end portions of the first support beam and the engaging arm to secure the first support beam and the engaging arm together in spaced parallel relation to one another;

means for supporting the length of pipe on the engaging arm, said supporting means being positioned about the engaging arm at spaced locations on the first and second end portions thereof; and means for providing a spray of fluid, said spraying means being secured to the second end portion of the engaging arm.

2. A pipe handling apparatus as set forth in claim 1 wherein the supporting means for the pipe further includes a first cylindrical member positioned about the first end portion of the engaging arm and a second cylindrical member positioned about the second end portion of the engaging arm, said cylindrical members being of a diameter smaller than that of the pipe member so as to center the pipe member thereon when the engaging arm is brought into contact with an internal portion of the pipe member.

3. A pipe handling apparatus as set forth in claim 2 wherein the pipe handling apparatus is adapted to be mounted to a linkage arrangement of a vehicle for movement in both a horizontal and vertical plane to move lengths of pipe from a first location to a second location within a trench to be secured to a plurality of pipe members that form a portion of a pipeline.

4. A pipe handling apparatus as set forth in claim 3 wherein the linkage arrangement of the vehicle is adapted for movement in a vertical plane and includes a primary boom member having a first end portion mounted to the vehicle for pivotal movement with respect thereto and a second, distal end portion, and a secondary boom having a first end portion pivotally mounted to the distal end of the primary boom member and a second end portion that mounts the pipe handling apparatus.

5. A pipe handling apparatus as set forth in claim 4 wherein a rotary coupler mounts the pipe handling apparatus to the secondary boom in a manner sufficient to rotate the pipe handling apparatus in a plane that is normal to the plane of movement of the secondary boom to fully manipulate the length of pipe supported on the engaging arm with respect to the pipeline in the trench.

6. A pipe handling apparatus as set forth in claim 5 wherein the rotary coupler is attached the secondary boom by a quick coupling apparatus.

7. A pipe handling apparatus as set forth in claim 3 wherein the spraying means includes a conduit that extends from a tank of sealing fluid carried by the vehicle to the spraying means for delivery of sealing fluid under pressure thereto.

8. A pipe handling apparatus as set forth in claim 7 wherein the spraying means further includes a nozzle member that extends from the second end portion of the engaging arm to a location that is proximate to an end portion of the supported length of pipe and is sufficient to spray sealing fluid radially therefrom to seal the connection between the length of pipe and the end of the pipeline upon connection therewith.

9. A pipe handling apparatus as set forth in claim 2 wherein the first cylindrical member includes a vertically extending flange member that is sufficient for positioning adjacent and in contact with an end face of the pipe member to facilitate movement of the pipe member into engagement with the pipeline in the trench.

* * * * *